US005170183A

United States Patent [19]

Hirabayashi et al.

[11] Patent Number: 5,170,183

[45] Date of Patent: Dec. 8, 1992

[54] RECORDING MEDIUM DISCHARGE MECHANISM FOR PRINTER

[75] Inventors: Hiromu Hirabayashi; Satoshi Fujioka, both of Nagano, Japan

[73] Assignee: Seiko Epson Corporation, Tokyo, Japan

[21] Appl. No.: 709,568

[22] Filed: Jun. 3, 1991

[30] Foreign Application Priority Data

Jun. 5, 1990 [JP] Japan ..... 2-146774
Mar. 7, 1991 [JP] Japan ..... 3-40382

[51] Int. Cl.[5] ..... G01D 15/24
[52] U.S. Cl. ..... 346/134; 271/161; 271/188; 271/209
[58] Field of Search ..... 346/134; 271/161, 188, 271/209

[56] References Cited

U.S. PATENT DOCUMENTS 3,991,996 11/1976 Bass ..... 271/80
4,767,114 8/1988 Nishimoto ..... 271/209 X

FOREIGN PATENT DOCUMENTS 2913595 10/1979 Fed. Rep. of Germany .

OTHER PUBLICATIONS

Shiratori Patent Abstracts of Japan vol. 12, No. 91 (M-679)(2938) Mar. 24, 1988.

*Primary Examiner*—Benjamin R. Fuller
*Assistant Examiner*—Gerald E. Preston
*Attorney, Agent, or Firm*—Sughrue, Mion, Zinn, Macpeak & Seas

[57] ABSTRACT

A recording medium discharge mechanism which discharges a recording medium (S) into a discharge tray (14) using a sheet discharge roller (69) and a sheet discharge biasing roller (72) that confronts the sheet discharge roller (66). The sheet discharge roller (69) has a plurality of vortical teeth extending in the direction of rotation of the sheet discharge roller. When the tail end of the recording medium (S) approaches the discharge roller (69), the circumferential speed of the sheet discharge roller (69) is increased so that the recording medium (S) can be accelerated into the sheet discharge tray (14) while biasing the tail end of the recording medium (S).

8 Claims, 4 Drawing Sheets

RECORDING MEDIUM DISCHARGE MECHANISM FOR PRINTER

BACKGROUND OF THE INVENTION

The invention relates to a recording medium discharge mechanism for use in printers.

A conventional recording sheet discharge mechanism for printers will be described with reference to FIGS. 5 and 6(*a*)–6(*c*). FIG. 5 is a sectional view showing a recording sheet discharge mechanism. A recording sheet S, which has already been printed by a recording head 82, is interposed under pressure between a sheet discharge roller 69 and a sheet discharge biasing roller 72 which are disposed at the front end of a sheet discharge tray 14. The recording sheet S is discharged into the sheet discharge tray 14 by rotating the sheet discharge roller 69 in a direction indicated by the arrow in FIG. 5 from a torque transmitted by a drive means (not shown).

FIG. 6(*a*) shows the profile of the sheet as discharge rollers 69 including a plurality of rectangular teeth disposed on the outer peripheral surface thereof. Further, as shown in FIG. 6(*b*), the sheet discharge biasing rollers 72 are disposed so as to be slightly staggered relative to the sheet discharge rollers 69 in the axial direction of the rollers and to be slightly superimposed one upon the other in the radial direction. The printed recording sheet S is interposed between the sheet discharge rollers 69 and the sheet discharge bias rollers 72 so as to form a large wave extending in the width-wise direction of the sheet, as illustrated, causing the sheet to be relatively rigid. The sheet discharge rollers 69 are rotated by a drive means (not shown) such that the recording sheet S is forwarded and discharged. When feeding and discharging the recording sheet S into the sheet discharge tray 14, as shown in FIG. 6(*c*), as its tail end reaches the sheet discharge rollers 69, the toothed portion formed on the peripheral surface of each sheet discharge roller 69 urges the recording sheet S into the sheet discharge tray 14.

However, the conventional device has experienced the following problems. When printing with an ink jet printer, which prints a recording object while spraying ink droplets onto a recording medium, a printed portion on the recording sheet is still wet when the recording sheet is to be discharged. Since the sheet discharge mechanism shown in FIG. 6 causes the printed recording sheet to be clamped between the sheet discharge roller and the sheet discharge biasing roller, the printed object becomes smeared. Further, since the recording sheet is no longer fed after its tail end passes the area at which it is held between the sheet discharge roller 69 and the sheet discharge biasing roller 72, conveyance of a succeeding recording sheet is obstructed by the tail end of the preceding recording sheet which is still disposed near the sheet discharge roller 69, thus leading to jamming of the sheets.

On the other hand, to discharge a recording sheet which is not curled while using the sheet discharge mechanism shown in FIGS. 6(*a*)–6(*c*), the toothed portion pushes the tail end of the recording sheet, thereby allowing the recording sheet to be discharged into the sheet discharge tray. However, if the tail end of the recording sheet is noticeably curled prior to printing, and if the ink jet printer is used, the curl of the tail end of the sheet may become more pronounced. As a result, the tail end of the sheet may be curled to such a degree that the tail end does not contact the toothed groove portion of the sheet discharge roller. In this case, the recording sheet will not be completely discharged by the sheet discharge roller into the sheet discharge tray. Accordingly, a succeeding recording sheet may become jammed by the tail end of the preceding sheet still present on the sheet discharge roller.

SUMMARY OF THE INVENTION

The invention has been made in view of the above circumstances. Accordingly, an object of the invention is to provide a recording medium discharge mechanism for a printer which can properly discharge a printed recording medium into a recording sheet discharge tray independently of the states of the recording means and recording medium.

This object has been achieved by a recording medium discharge mechanism, comprising recording image printing means for printing a recording image on a recording medium, a first roller disposed downstream of the recording image printing means and driven by a drive motor while contacting a back surface of the recording medium, the first roller having a vortically toothed peripheral portion, a second roller disposed so as to face the image forming surface of the recording medium in opposition to the first roller and driven by the first roller and a sheet discharge tray disposed below the first and second rollers for accommodating the recording medium. The toothed portion of the first roller includes a plurality of teeth have inner and outer peripheral surfaces made of materials whose frictional coefficient are different from each other. In particular, the inner surface of each teeth has a frictional coefficient which is larger than that of the outer surface. In this manner, the tail end of the recording medium can be urged into the sheet discharge tray due to the high frictional coefficient of the inner surface of the teeth.

DETAILED DESCRIPTION OF THE PREFERRED EMBODIMENTS

Embodiments of the invention will be described with reference to the accompanying drawings.

Figure 1:
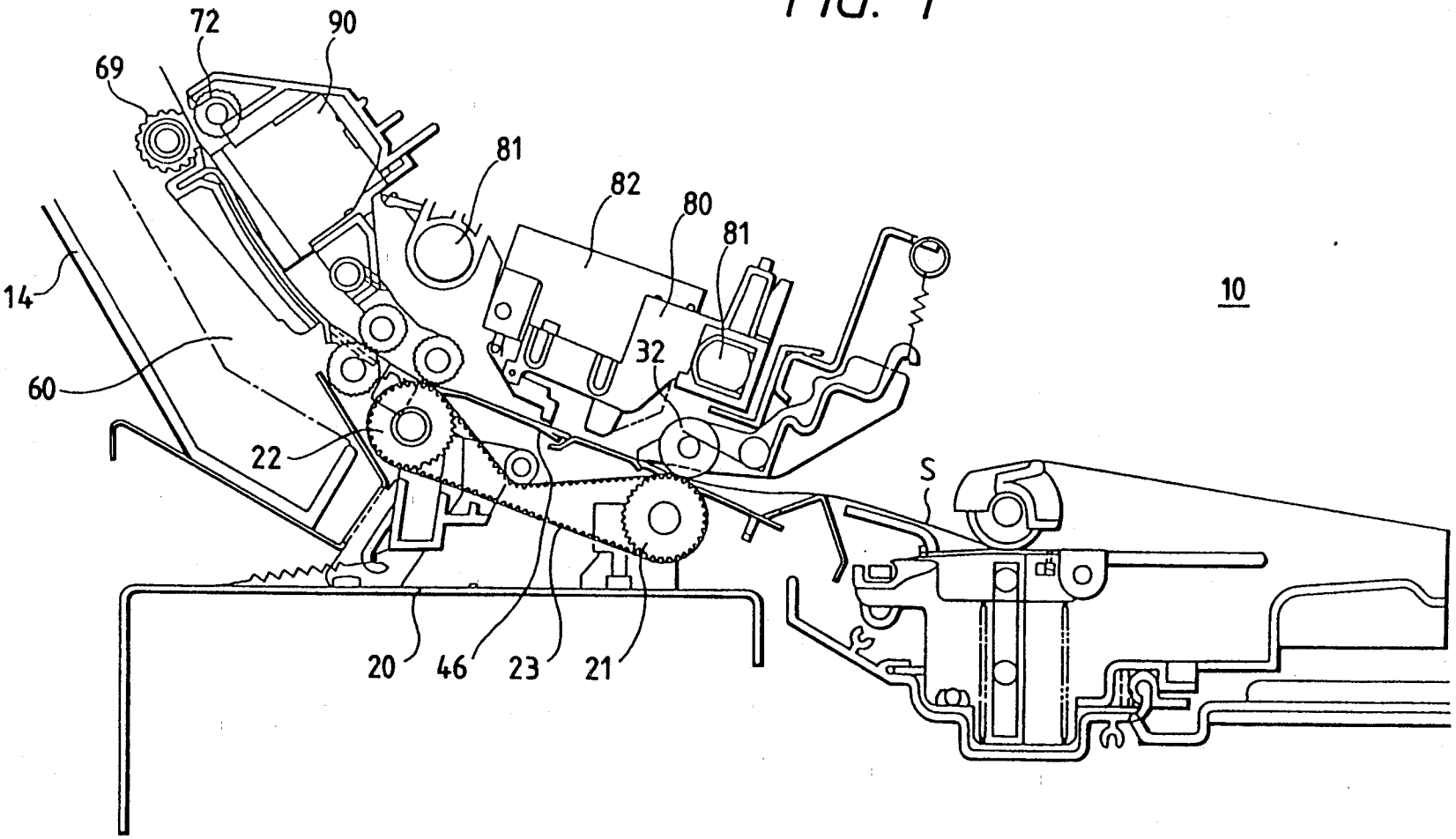
FIG. 1 is a side view showing the general aspect of an ink jet printer having a recording medium discharge mechanism, which is an embodiment of the invention.

FIG. 1 generally illustrates an ink jet printer having a recording sheet discharging medium according to a first embodiment of the invention. This printer generally includes a sheet feed section 10, a sheet forwarding section 20 disposed in a recording section, and a sheet discharge section 60 for discharging a recording sheet S in the process of drying it.

In the recording sheet section 20, a gate roller 21 is connected to a drive force transmitting mechanism (not shown) on the side upstream of a carriage 80. Additionally, a driven roller 22 is positioned immediately after a platen 46 arranged downstream of the carriage. The driven roller 22 is so arranged as to rotate at the same circumferential speed as that of the gate roller 21 through a recording sheet belt 23 that is installed between the gate roller 21 and the driven roller 22. The recording sheet forward belt 23 is constructed so that a recording sheet biasing roller 32 biases the belt 23 by a frictional force generated between the belt and the roller. The recording sheet S is conveyed by the sheet feed section 10 until it is clamped between the sheet forward belt 23 and the sheet biasing roller 32, and is recorded by a recording head 82 based on input information. The recording head 82 is secured to a carriage that travels along two guide rails 81, 81 which are installed above the printing section so as to intersect orthogonally in the sheet forwarding direction. The recording sheet S is then forwarded to the sheet discharge section 60 by the sheet forwarding belt 23 and the sheet biasing roller 32.

Figure 2:
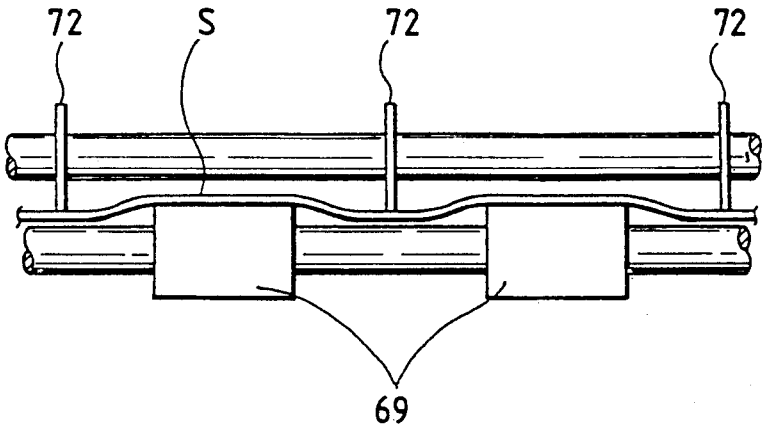
FIGS. 2, 3 and 4, are views showing specific portions of the recording medium discharge mechanism shown in FIG. 1, respectively.

The sheet discharge section 60 includes a heated air-based drying unit 90, a plurality of sheet discharge rollers 69, and a plurality of sheet discharge biasing rollers 72. As shown in FIG. 2, the sheet discharge biasing rollers 72 are arranged to be slightly staggered relative to the sheet discharge rollers 69 in the axial direction of the rollers and to be slightly superimposed in the radial direction. Accordingly, the ink on the recording sheet S, forwarded by the sheet discharge section 60, is dried by the heated air of the drying unit 90 such that the sheet is deformed in a wave-like manner as a result of being clamped between the sheet discharge rollers 69 and the sheet discharge biasing rollers 72. Therefore, the recording sheet S is thus forwarded to a sheet discharge tray 14 in a relatively rigid state.

Figure 3:
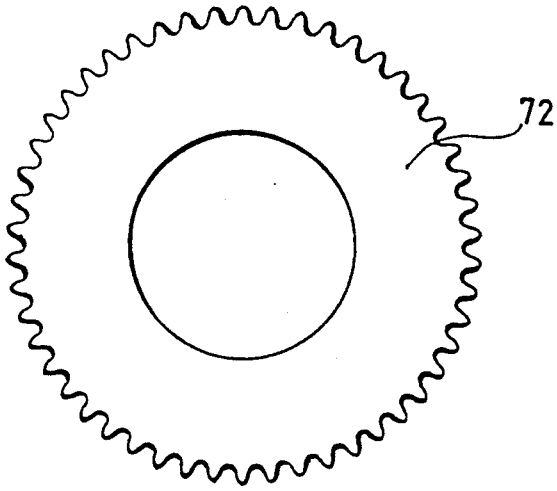

As shown in FIG. 3, each discharge sheet biasing roller 72 is formed of a thin plate member whose peripheral surface is provided with triangle-like teeth. Accordingly, even if a portion of the sheet, having a large printing density which has not been dried by the heated air-based drying unit 90, comes into contact with the discharge sheet biasing rollers 72, the recording sheet can be forwarded and discharged without smearing the printed characters due to the relatively small contact area of the roller 72 on the sheet.

Figure 4:
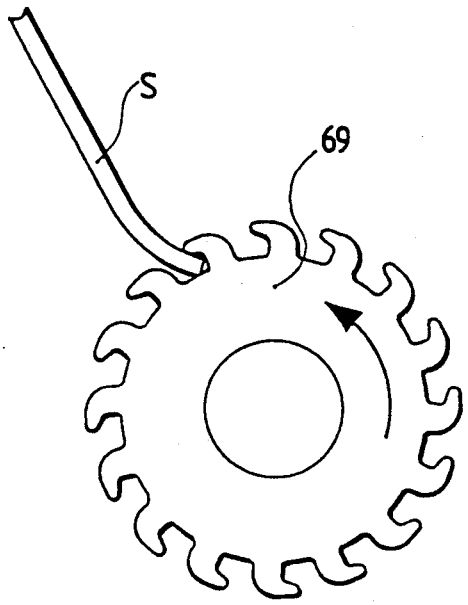
Figure 5:
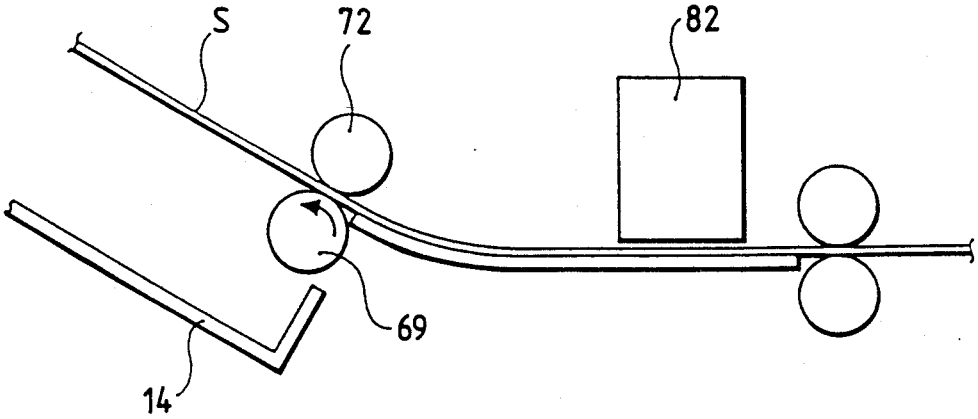
FIG. 5 PRIOR ART
FIGS. 5 and 6(*a*)–6(*c*) are views illustrating a conventional recording medium discharge mechanism.
Figure 6A:
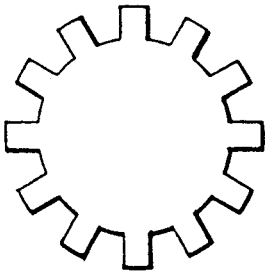
FIG. 6(a) PRIOR ART
Figure 6B:
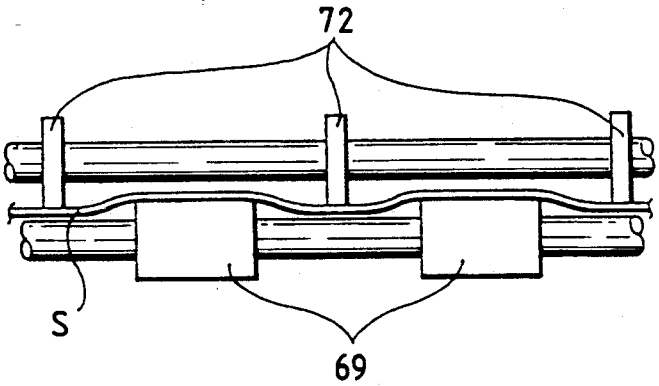
FIG. 6(b) PRIOR ART
Figure 6C:
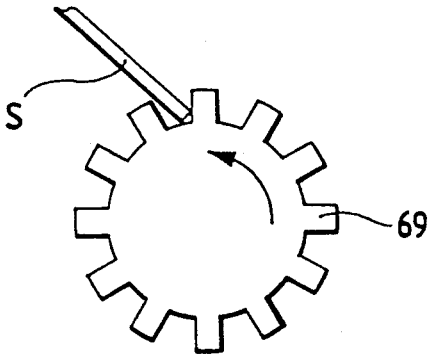
FIG. 6(c) PRIOR ART

Further, as shown in FIG. 4, each sheet discharge roller 69 has its peripheral surface provided with vortical teeth. When a sensor (not shown) detects the tail end of the recording sheet S and the tail end is passing between the sheet discharge rollers 69 and the discharge biasing rollers 72, even if the tail end of the sheet S is curled due to printing, the curled tail end of the recording sheet S can still be contacted by the vortical portions of each sheet discharge roller 69. As a result, a downward force is applied to the recording sheet S, ensuring that the recording sheet will fall into the tray without jamming succeeding sheets. Specifically, the recording sheet S is discharged into the sheet discharge tray 14 by rotating the sheet discharge rollers 69 by a drive means at a circumferential speed higher than the speed prior to the detection by the sensor, and by applying an inertial force to the recording sheet S in the sheet discharge direction while biasing its tail end so as to accelerate the sheet into the tray. Each sheet discharge roller 69 is formed in one piece by a plastic such as PA (polyamide (nylon) resin), polyacetal resin, polycarbonate resin, etc.

Figure 7:
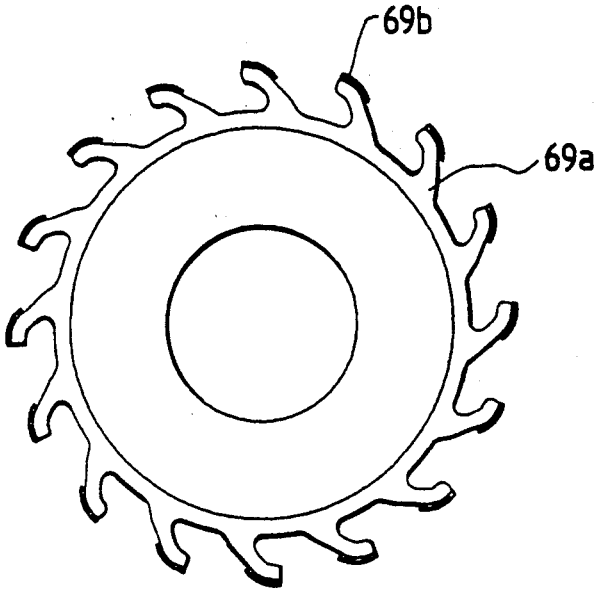
FIGS. 7 and 8 are views showing other embodiments of the invention.
Figure 8:
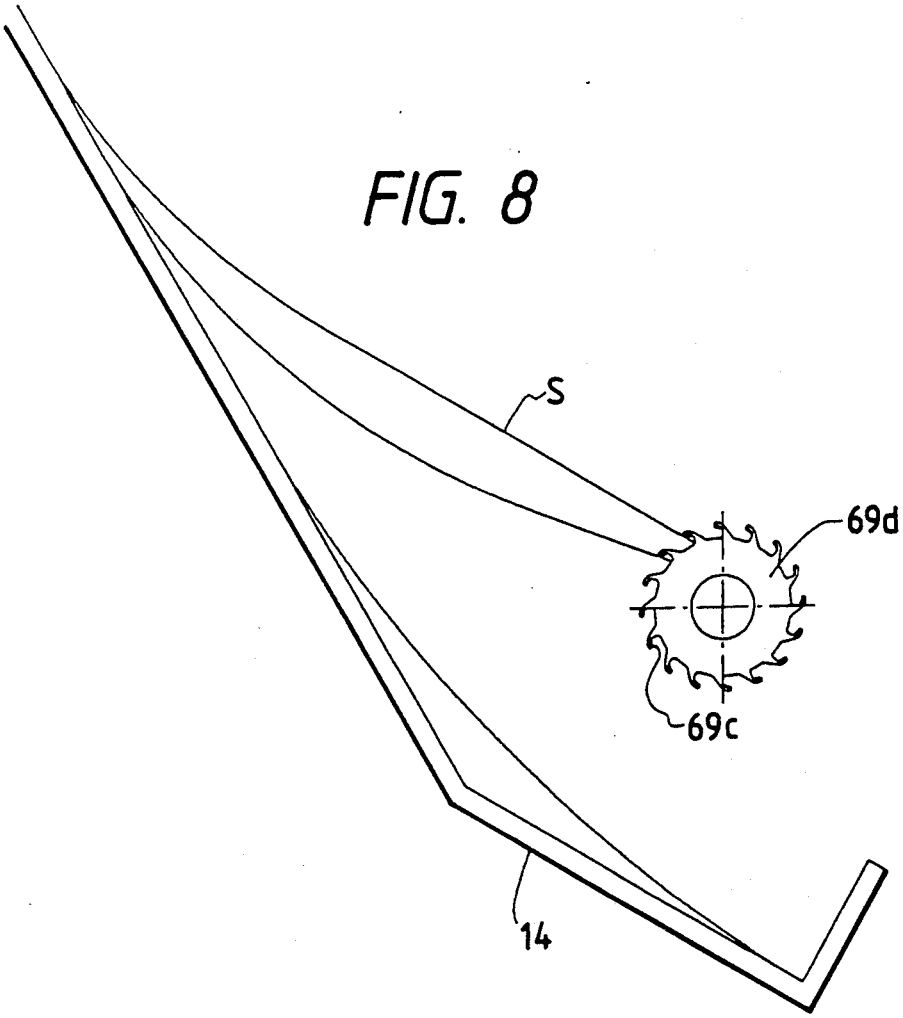

FIGS. 7 and 8 are diagrams respectively showing other embodiments of the invention which are different from the one shown in FIG. 4. In FIG. 7, a vortically toothed sheet discharge roller 69 is formed of a roller **69*a* made of an adhesive rubber as the inner surface of each vortical tooth and a film member 69*b* as the outer surface. The adhesive rubber roller 69*a* is made of a rubber material having an extremely large friction coefficient, while the film member 69*b*** is made of a material having a friction coefficient substantially equal to that of plastic.

In FIG. 8, a vortically toothed sheet discharge roller 69 is formed of an adhesive rubber member **69*c* as the inner surface of each vortical tooth and a roller 69*d* made of a plastic as a roller body. The adhesive rubber member 69*c* is bonded to the inner surface of a monolithically formed plastic roller 69*d*. The adhesive rubber member is made of a material having a friction coefficient far larger than that of the plastic roller 69*d***.

According to the FIG. 7 and 8 embodiment, the outer surface of the sheet discharge roller 69 is made of a plastic **69*d* or a member 69*b*** made of a material having a friction coefficient as large as that of the plastic, and, when forwarding the recording sheet S, it applies a frictional force large enough to generate an appropriate forwarding force to the recording sheet S.

When the tail end of the recording sheet S passes through the sheet discharge roller 69, the recording surface at the tail end of the recording sheet S comes into contact with the rubber portions of the sheet discharge roller 69 whose friction coefficient is relatively large. As a result, a strong holding force derived from each rubber portion **69*a* or 69*c*** allows the recording sheet S to be guided thereby even at its tail end, hence ensuring a proper discharge operation.

As described in the foregoing, the recording sheet discharge mechanism according to the invention includes the sheet discharge rollers whose peripheral surfaces, which come into contact with the back surface of the recording medium, are provided with vortical teeth, and the plate-like sheet discharge biasing rollers whose peripheral surfaces are also provided with teeth, both being arranged adjacent to the sheet discharge tray. Further, when the recording sheet is being discharged into the sheet discharge tray, the circumferential speed of the sheet discharge roller is increased over the normal sheet forwarding speed, thereby allowing the recording sheet to be discharged into the sheet discharge tray without smearing the printed portion. Further, even if the recording sheet is curled, the vortically toothed portion over the peripheral surface of each sheet discharge roller serves to discharge the recording sheet while biasing its curled tail end, thereby ensuring that the recording sheet is discharged into the sheet discharge tray without leaving its tail end contacting the sheet discharge roller. This contributes to preventing sequentially discharged sheets from being jammed.

What is claimed is:

1. A recording medium discharge mechanism for a printer, comprising:

means for printing a recording image on a recording medium;

a first roller disposed downstream of said recording image printing means and driven by a drive motor while contacting a back surface of said recording medium, said first roller having a vortically toothed peripheral portion including a plurality of teeth curved in a substantially tangential direction to said first roller;

a second roller disposed so as to face the image forming surface of said recording medium in opposition to said first roller and driven by said first roller; and a sheet discharge tray disposed below said first and second rollers for accommodating said recording medium.

2. A recording medium discharge mechanism according to claim 1, wherein said vortically toothed portion include a plurality of teeth having inner and outer peripheral surfaces made of materials whose friction coefficients are different from each other.

3. A recording medium discharge mechanism according to claim 2, wherein said inner surface of said teeth has a friction coefficient larger than that of said outer surface.

4. A recording medium discharge mechanism according to claim 1, wherein the vortically toothed portion formed over the peripheral surface of said first roller is monolithically formed of a plastic.

5. A recording medium discharge mechanism according to claim 1, wherein the vortically toothed portion formed over the peripheral surface of said first roller has vortical teeth, each extending in a direction of rotation of said first roller.

6. A recording medium discharge mechanism according to claim 1, further comprising means for adjusting the rotational speed of said first roller such that when an end of a recording medium has approached said first roller, a speed of said first roller is increased.

7. A recording medium discharge mechanism of claim 1 wherein said second roller is a thin-plate member, the peripheral surface of which includes a plurality of teeth.

8. A recording medium discharge mechanism of claim 7 wherein said teeth are triangular in shape.

* * * * *